US007000647B2

(12) United States Patent
Vanthournhout et al.

(10) Patent No.: US 7,000,647 B2
(45) Date of Patent: Feb. 21, 2006

(54) DEVICE FOR ATTACHING AND GUIDING AT LEAST ONE TACKLE CORD IN A JACQUARD MACHINE AND JACQUARD MACHINE PROVIDED WITH ONE OR SEVERAL SIMILAR DEVICES

(75) Inventors: Filiep Vanthournhout, Heule (BE); Bram Vanderjeugt, Ypres (BE)

(73) Assignee: N.V. Michel Van de Wiele, Kortrijk/Marke (BE)

( * ) Notice: Subject to any disclaimer, the term of this patent is extended or adjusted under 35 U.S.C. 154(b) by 251 days.

(21) Appl. No.: 10/429,965

(22) Filed: May 6, 2003

(65) Prior Publication Data

US 2004/0003859 A1 Jan. 8, 2004

(30) Foreign Application Priority Data

May 7, 2002 (BE) ..... 2002/0301

(51) Int. Cl.
*D03C 3/14* (2006.01)

(52) U.S. Cl. ..... 139/60

(58) Field of Classification Search ..... 139/60, 139/21, 55.1, 317, 61–65, 85
See application file for complete search history.

(56) References Cited

U.S. PATENT DOCUMENTS 541,646 A * 6/1895 Weaver ..... 139/60
592,005 A * 10/1897 Hardwick ..... 139/60
1,648,139 A * 11/1927 Machon ..... 139/55.1
3,853,150 A * 12/1974 Romano ..... 139/55.1
4,448,046 A * 5/1984 Mista et al. ..... 66/205
4,572,247 A * 2/1986 Speich ..... 139/455
4,739,806 A 4/1988 Palau et al.
5,010,927 A * 4/1991 Keim ..... 139/89
5,222,526 A * 6/1993 Derudder ..... 139/65
5,353,846 A * 10/1994 Gheysen et al. ..... 139/65
5,868,173 A * 2/1999 Derudder et al. ..... 139/65

FOREIGN PATENT DOCUMENTS

BE 1008974 10/1996
DE 8705603 U 6/1987
EP 0219437 4/1987
EP 0801161 10/1997
EP 1096049 5/2001

* cited by examiner

*Primary Examiner*—John J. Calvert
*Assistant Examiner*—Andrew W. Sutton
(74) *Attorney, Agent, or Firm*—James Creighton Wray; Meera P. Narasimhan

(57) ABSTRACT

The invention on the one hand relates to a device for attaching and guiding of at least one tackle cord (2) in a Jacquard machine, the device (1) being designed for being attached to a part (20) of the Jacquard machine and being designed for being connected to at least one tackle cord (2), the device (1) being provided with a springy element (15) exercising a pushing force on the device (1) in a direction which is opposite to the tractive force exercised on the device (1) by the tackle cord (2). The invention further relates to a Jacquard machine, which is provided with a fixed, adjustable or movable grid and a number of retaining plates, which are attached to the grid and which are provided for attaching a number of devices according to anyone of the above-mentioned claims.

12 Claims, 2 Drawing Sheets

DEVICE FOR ATTACHING AND GUIDING AT LEAST ONE TACKLE CORD IN A JACQUARD MACHINE AND JACQUARD MACHINE PROVIDED WITH ONE OR SEVERAL SIMILAR DEVICES

This application claims the benefit of Belgian Application No. 2002/0301 filed May 7, 2002.

BACKGROUND OF THE INVENTION

The invention relates to a device for attaching and guiding at least one tackle cord in a Jacquard machine, the device being provided for being attached to a part of the Jacquard machine and being provided for being attached to at least one tackle cord.

Jacquard machines are provided with a tackle device in order to obtain the open shed principle and/or to obtain a boosting of movement for lifting. In such a tackle device an end of the lower tackle cords is attached to a grid or a frame. This end of the lower tackle cord is called the fixed end of the tackle cord. The other end of the lower tackle cord is connected to one or several cords of the harness in order to carry out the lifting of the Jacquard heddles. This end is called the movable end of the lower tackle cords.

The grid to which the fixed end of the lower tackle cord is attached, may be attached to the frame of the Jacquard machine, adjustable as to height or may also be connected to a mechanism to carry out an up and down movement. Thus, in BE 1 008 974 a tackle grid moving up and down is discussed and in EP 0 219 437 an implementation is represented in which the fixed ends of the tackle cords are attached fixedly and unadjustably to the guiding walls of the tackle.

Devices with adjustable tackle grids have the advantage that the height of the heddle eyes of the Jacquard heddles may be adjusted without having the complete Jacquard machine to be adjusted as to height by a simple adjustment as to height of the tackle grid.

To attach the fixed end of the tackle cords, various embodiments are known. A first embodiment is represented in BE 1 008 974, where the fixed end of the lower tackle cords is hingedly attached to a claw-shaped reed, by means of a T-shaped anchor of synthetic material extruded to form one piece with the cord.

A disadvantage of this device is that, to replace the lower tackle cord in case of possible rupture or wear, the T-shaped anchor must be pushed out of the claw-shaped reed. However, this operation is not too easy to carry out because of the poor accessibility to the rows of the tackle grid.

Another inconvenience is that no guide is provided for guiding the movable ends of the tackle cords. Therefore the tackle cords may rub against the grid bars when the tackle cords are breaking out sideways in case of rapid up and down movements and the return spring device of the harness fails, for a short while, for one reason or another.

Further, a tackle cord connection is known, which indeed provides a guiding eye for the movable tackle cord. The connection consists of an I-shaped piece made of synthetic material in which the fixed end of the tackle cord of the lower tackle cord is maintained in the upper surface in a claw-shaped part as described above and in which down at the base guiding eyes have been provided for the movable end of the lower tackle cord.

It is first of all an inconvenience that the tackle cord still has to be hooked on a claw-shaped part.

Another problem is that several tackle cords are attached to one little block. The I-shaped attachments are stuck onto metal supporting strips, which are attached to the grid. To replace an I-shaped block, the strip has to be pushed out of all the other blocks of one row. This is a very time-consuming operation.

Moreover, with such a device, the pitch of the Jacquard machine is not well respected, because the blocks may get shifted on the metal strip. This causes the danger that the tackle cords may be pulled out of position, in a slanting position causing wear and tear of the guiding of the hooks. Further, the claws at the ends of a block are weak.

SUMMARY OF THE INVENTION

The purpose of the invention is to provide for a device for attaching and guiding at least one tackle cord in a Jacquard machine not having the above-mentioned disadvantages. It is likewise a purpose of the invention:

- to provide for the attachment and guiding of at least one tackle cord which will not come loose under the influence of the load occurring during operation;
- to provide for a device which is not slidable on the grid bar, so that the pitch of the hooks of the Jacquard machine can be maintained and the tackle cords will not get out of position.
- to provide for a more compact device.

These purposes are attained by providing for a device for attaching and guiding of at least one tackle cord in a Jacquard machine, the device being provided for being attached to a part of the Jacquard machine and being provided for being connected to at least one tackle cord and the device being provided with a springy element exercising a pushing force on the device in a direction opposite to the tractive effort exercised on the device by the tackle cord.

This has the advantage that the attachment and guiding of at least one tackle cord cannot come loose when the tackle cord is pulling at the device during operation. The device, which has been positioned on a part of the Jacquard machine, is further maintained in position in such a manner.

In a preferred embodiment of the invention, the device is provided with at least one projection which may be brought into a corresponding opening in said part of the Jacquard machine and the projection has a variable form or dimensions, the extremity of the projection having a form or dimensions larger than the form or the dimensions of said opening, such that the projection brought into the opening is situated in a blocking position opposite the opening.

In a more specific preferred embodiment of the invention, the device is provided with two projections, namely a first and a second projection, which have been designed in order to be brought into a first and a second opening respectively.

In a still more specific preferred embodiment of the invention, the two projections have an at least partly cylindrical form having two or more diameters, the extremities of the projections having the largest diameter and the part situated between this extremity and the attachment of the projections to the device having the smallest diameter.

In a specific preferred embodiment of the device according to the invention, said second opening comprises two partial openings, a first partial opening having a diameter which is larger than the extremities of the second projection and a second opening having a diameter which is larger than or fitting for this part situated between the extremity and the attachment of the projections of the device.

In a still more specific preferred embodiment of the device according to the invention, these said partial openings are open circles, there being an opening angle between the two circles which is less than 180° and the second projection being provided with a third part, situated between said extremity of the projection and said second part, the diameter being larger than the diameter of said second part and smaller than the diameter of the extremity of the second projection and it being not possible to shift said third part through said opening angle, but having indeed a diameter which is fitting for or smaller than the diameter of the second partial opening of said second opening.

A similar projection and similar recesses as described above being provided has the advantage that the device is maintained in the part of the Jacquard machine mentioned above in an unambiguous manner. Further, it is not possible to detach the device without exercising a downward force on the device against the force exercised on the device by the springy element. Applying said device to the above-mentioned part of the Jacquard machine occurs by a combination of horizontal and vertical movements, the horizontal movement near the part being less than 10 mm, allowing the Jacquard machine being kept compact. Because the device is well accessible, the height of the tackle cord may be kept limited, while the operator has yet sufficient access to locate and replace the tackle cords. This has a direct influence on the installation height of the complete installation, which, in such manner, may be kept more compact.

In a preferred embodiment of the device according to the invention, said part of the Jacquard machine is a retaining plate on which one or more devices may be installed.

In a particularly advantageous embodiment of the device according to the invention, said device is provided with at least one recess, having the form of the corresponding tool for installing or removing one or several devices.

In a particularly preferred embodiment of the device according to the invention, the device is provided with two recesses, at least one recess having a bulge which fits into an opening, said bulge and said opening having been designed such that when sliding the tool on the said device, the tool will slide over the bulge in a springy manner, until the opening in the tool encloses the bulge of the device.

This has the advantage that the device can only be removed from the retaining plate by the reactive forces coming into being when the device is maintained in the retaining plate. In this manner, also several devices according to the invention may be interchanged by means of a suitable tool, so that this operation is suitable for automation.

Another problem of the devices known is that the anchoring point lies at the top and the guide eye at the bottom, because of which a kind of a channel is formed between two grid bars situated next to one another, in which a lot of dust will be accumulated during the weaving process. In case it might be desirable to blow away the dust from the tackle grids by means of a jet of compressed air, the dust is likely to be blown into the channel and the harness cords will be dragged through this dust. This causes premature wear and tear of the end of the movable tackle cord of the lower tackle cord.

A further purpose of the invention consists in providing a device for attaching at least one tackle cord, providing a guide for the free end, and where no dust collecting channel will be formed by two rows situated next to one another.

This purpose is obtained by providing a device according to the invention, the top of the device comprising at least one plane inclining downwards towards the side.

Another problem of the known tackle cord connections being provided with a guide eye for the movable tackle cord, is that the guide eyes are situated at the bottom of the tackle cord connection, because of which, by pulling the guide eye to the front, there is indeed a good visibility all around the tackle cord, but pulling the tackle cord through the guide eye in the rear still requires quite some groping and searching.

A further purpose of the invention therefore is to provide a device for attaching at least one tackle cord having a guide which may be speedily heddled and where an individual replacement should be possible, the attachment of a tackle cord being easily to locate and to be reached.

This purpose is attained because the device comprises two guide eyes, being situated at different levels.

This has the advantage that the device may be attached to said part of the Jacquard machine in such a manner that the guide eye situated lowest is placed at the front, such that the guide eye is well in sight, while the guide eye placed uppermost is placed at the back and visibility is well enough for the tackle cord to be pulled through the guide eye.

The purpose of the invention is further attained by providing a Jacquard machine equipped with a fixed, adjustable or movable grid and a number of retaining plates, which are attached to the grid and which are designed for attaching a number of devices according to one of the claims mentioned above.

The characteristics and particulars of the present invention are explained hereafter by means of an exemplifying embodiment, making reference to the attached drawings. It should be noted that specific aspects of this example are described only as a preferred example of what is intended in the scope of the above-mentioned general description of the invention and may on no account be interpreted as a restriction of the scope of the invention as such and as expressed in the following claims.

In the attached drawings:

DETAILED DESCRIPTION OF THE PREFERRED EMBODIMENTS

Figure 1:
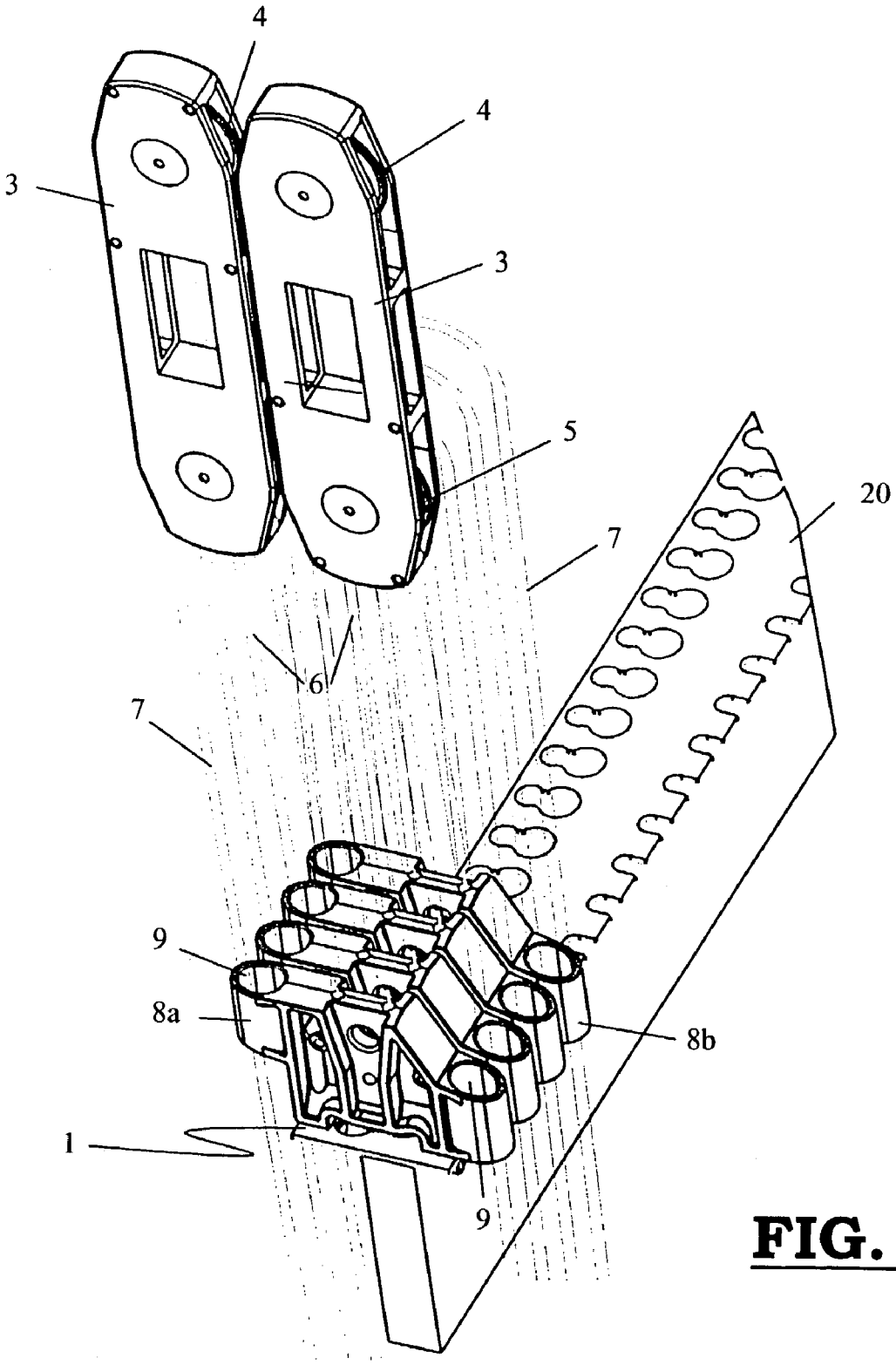
FIG. 1 is a perspective top view of a device according to the invention, provided with two lower tackle cords.

The device for attaching and guiding at least one tackle cord consists of a fastening clip (1), operating two adjoining rows of lower tackle cords (2), as shown in FIG. 1. Each lower tackle cord (2) is connected to the upper tackle cords (not represented in the figure) through a tackle element (3) equipped with two tackle pulleys (4, 5). The lower tackle cord (3) is divided into a movable tackle cord end (6) and a fixed tackle cord end (7) by the lower tackle pulley (5).

Figure 2:
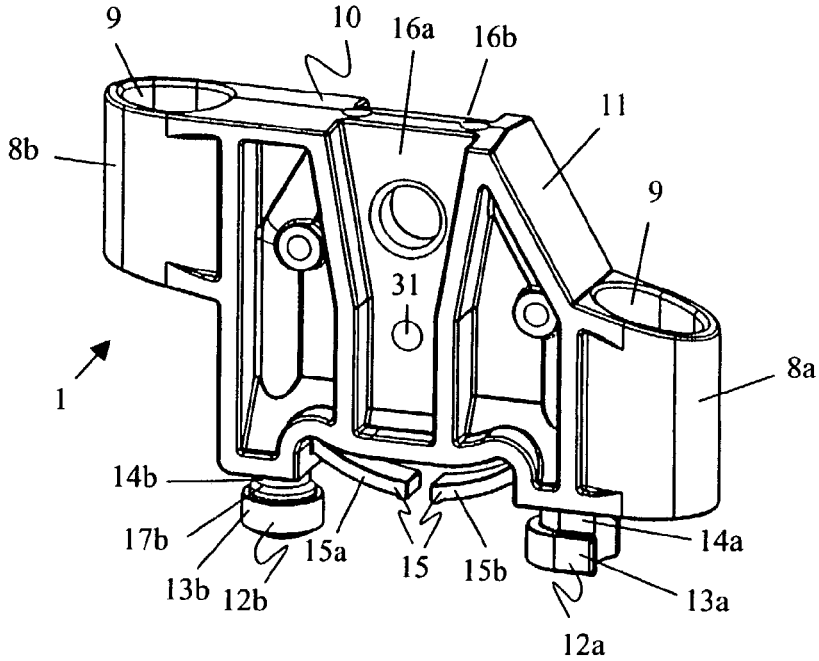
FIG. 2 is a perspective front view of a fastening clip according to the invention.

As shown in the FIGS. 1 and 2, the fastening clip (1) is extruded to form one piece with the fixed tackle cord end (6) of the lower tackle cord (2). Integral extruding occurs over the total height of the fastening clip (1) and therefore produces a good attachment of the tackle cord (2) to the fastening clip (1). The fastening clip (1) is provided with two projecting ears, namely a first ear (8*a*) and a second ear (8*b*). These ears (8*a*, 8*b*) are provided with a vertically directed guide eye (9) for the movable tackle cord end (7). The first ear (8*a*) which is situated lowest on the fastening clip (1) is placed at the back. In such a manner the visual range is good for pulling the tackle cord (2) through the guide eyes (9), which are situated in the ears (8*a*, 8*b*). The dimensions of the guide eyes (9) are such, that by slightly moving away from one another the holes in the baseplate (not represented in the figure) through which the tackle cords are heddled, the tackle cords have a certain pre-tension and will rub against the side of the guide eyes (9) because of which the tackle cords (2) are well guided.

The top (10) of the fastening clip (1) is provided with at least a plane (11) inclining downwards to the side, helping to prevent the dust from accumulating, but allowing it to escape downwards.

Through two projections, a first projection (12*a*) and a second projection (12*b*), the fastening clip (1) is attached to a retaining plate (20), provided with a first (21*a*) and a second opening (21*b*) to insert the respective projections (12*a*, 12*b*).

The projections (12*a*, 12*b*) have variable forms or dimensions, the extremities (13*a*, 13*b*) of the projections (12*a*, 12*b*) having the largest forms or dimensions, and the second parts (14*a*, 14*b*) situated between these extremities (13*a*, 13*b*) and the attachments of the projections (12*a*, 12*b*) to the fastening clip (1) having the smallest forms and dimensions.

The first projection (12*a*) partly has a cylindrical form, more particularly the second part (14*a*) situated between the extremity (13*a*) and the attachment of the first projection (2*a*) to the fastening clip (1). The extremity (13*b*), however, is not cylindrical.

The entire second projection (12*b*) has a cylindrical form, yet a third part (17*b*) being provided between said extremity (13*b*) of the projection (12*b*) and said second part (14*b*), having a diameter which is larger than the diameter of said second part (14*b*) and smaller than the diameter of the extremity (13*b*) of the second projection (12*b*).

At the bottom, the fastening clip (1) is provided with at least one springy element (15). In this embodiment, two springy lips (15*a*, 15*b*) are provided which push the fastening clip (1) against the retaining plate (20). In this manner, the fastening clip (1), once it has been positioned on the retaining plate (20), is held in position by the pushing force of the springy element (15) opposite the fastening clip (1). In this manner the springy element (15) exercises a pushing force on the fastening clip (1) in a direction, which is opposite to the tractive force exercised on the fastening clip (1) by the fixed part (6) of the lower tackle cords (2).

The first opening (21*a*) and the second opening (21*b*) in the retaining plate (20) are chosen such that the fastening clip cannot be loosened without exercising a vertically downward force on the fastening clip (1) opposite the springy lips (15*a*, 15*b*) directed downwards. The first opening (21*a*) is located on the side of the retaining plate (20) and is open on this side. This first opening (21*a*) has a diameter, which is smaller than the diameter of the extremity (13*a*) of the first projection (12*a*). The opening (21*a*) has a diameter, which is larger than or fitting for the diameter of the second part (14*a*).

The second opening (21*b*) consists of two partial openings, namely a first (22*a*) and a second partial opening (22*b*), the first partial opening (22*a*) having a diameter which is larger than the largest diameter of the second projection (12*b*), more particularly, larger than the diameter of the extremity (13*b*) of this second projection (12*b*). The second partial opening (22*b*) has a diameter, which is larger than the diameter of the second part (14*b*) of this second projection (12*b*) and larger than or fitting for the diameter of the third part (17*b*) of the second projection (12*b*). Preferably, the two partial openings (22*a*, 22*b*) are circular, the opening angle between the two circles being smaller than 180°. It must be possible to shift the second part (14*b*) through the opening angle, while it should be impossible to shift said third part (17*b*) of the second projection (12*b*) through the opening angle, because of which the fastening clip (1) cannot been detached without exerting a vertically downward directed force on the device against the force exercised by the springy element (15) on the fastening clip (1).

Therefore the fastening clip (1) is brought into the retaining plate as follows:

- the second projection (12*b*) is inserted into the first partial opening (22*a*), and the first projection (12*a*) is brought opposite the first opening (21*a*);
- the fastening clip (1) is pushed vertically downwards, such that the springy lips (15*a*, 15*b*) are compressed. Now the projections (12*a*, 12*b*), together with the parts (14*a*, 14*b*) with the smallest diameter, are situated opposite the openings (21*a*, 21*b*);
- the fastening clip (1) is now shifted into the openings (21*a*, 21*b*), by a horizontal movement;
- the fastening clip (1) is making a vertically upward movement, because the springy lips (15*a*, 15*b*) are partly springing back, because of which the third part (17*a*) of the second projection (12*b*) becomes fixed, fitting into the second opening (21*b*) or at least cannot be shifted through the opening angle between the two partial openings (22*a*, 22*b*) of the second opening (21*b*) in the retaining plate (20) and the fastening clip (1) is fixed opposite the retaining plate (20).

Applying one or several fastening clips (1) occurs by a combination of horizontal and vertical movements, the horizontal movement near the retaining plate (20) being shorter than 10 mm, allowing the Jacquard machine to be kept compact.

Providing such an embodiment for installing a fastening clip (1) in the retaining plate (20) has the advantage that by lateral forces alone the fastening clip (1) cannot come loose because the second partial opening (22*b*) of the second opening (21*b*) in the retaining plate (20) has a diameter which is larger than the diameter of the third part (17*b*) of the second projection (12*b*). Only by pushing down the fastening clip (1), so that the part (14*b*) situated higher up, with the smaller diameter, positions itself opposite the retaining plate (20) the opening angle between the two partial openings (22*a*, 22*b*) is sufficiently large to remove the fastening clip (1) from the retaining plate (20).

Figure 3:
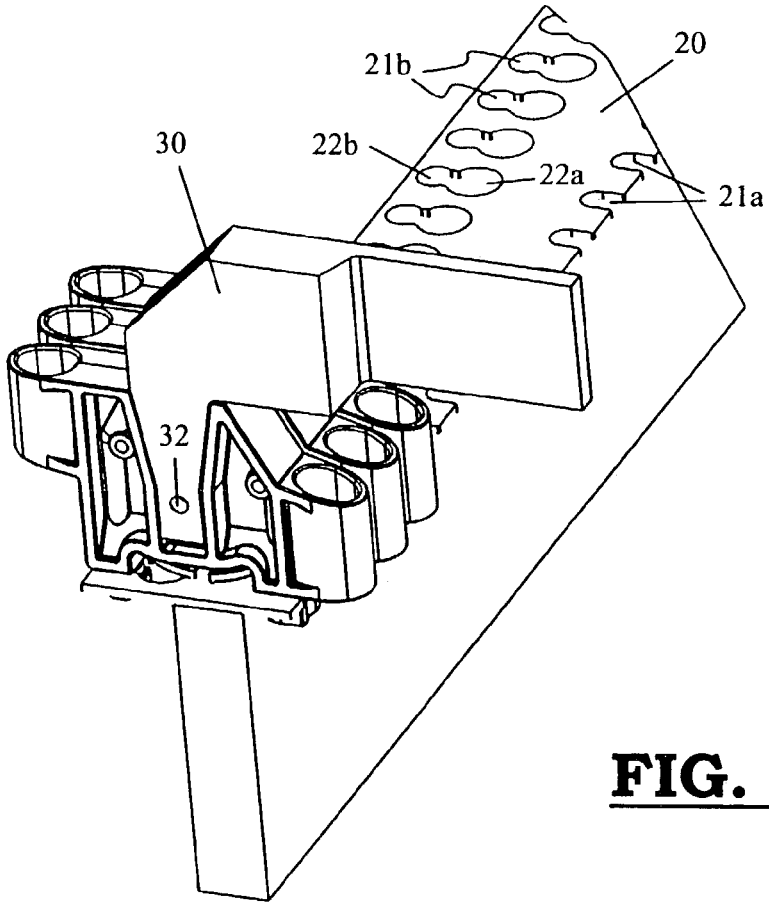
FIG. 3 is a perspective top view of a tool for installing or removing one or several fastening clips according to the invention.

On both sides, the fastening clip (1) has a recess (16*a*, 16*b*) in its lateral face, having the form of a corresponding tool (30) (as shown in FIG. 3) in order to install or to remove one or several fastening clips (1). At least one of the recesses (16*a*, 16*b*) is provided with a bulge (31) which fits into an opening (32) of the tool (30), the bulge (31) and the opening (32) being provided in such a manner, that when shifting the tool (32) onto the fastening clip (1), the tool (32) slides over the bulge (31) in a springy manner, until the opening (32) in the tool encloses the bulge (31) of the fastening clip (1). In this manner, detaching the fastening clip (1) from the retaining plate (20) may only occur by the reactive forces coming into being when the fastening clip (1) is maintained in the retaining plate (20).

The retaining plate (20) is designed for installing several fastening clips (1). To that effect, several first (21*a*) and second openings (21*b*) have been provided in a row in the retaining plate (20). The distance between the first openings (21*a*) or the second openings (21*b*) determines the pitch corresponding with the pitch of the hooks of the Jacquard machine. Therefore, the fastening clips (1) will not be shifted with respect to one another under the influence of vibrations and no tackle cords will be pulled out of position in a slanting position towards the hooks.

By means of a suitable tool (32) several fastening clips (1) may be installed or removed simultaneously, because of which this operation is suitable for automation.

In order to install the fastening clips (1) easily on the retaining plate (20), the retaining plate (20) has been strengthened by plate material or by solid material. In the Jacquard machine, these retaining plates (20) may be attached to a grid, which may be fixed, adjustable or movable.

With a similar embodiment of a fastening clip (1), as described above, the fastening clips (1) are accessible to such an extent, that the tackle cord height may be restricted, while the operator has a sufficiently good access to locate or to replace tackle cords. This will enable the height required for mounting a complete installation to be reduced and make it more compact.

What is claimed is:

1. Device for attaching and guiding at least one tackle cord (2) in a Jacquard machine, the device (1) being provided for being attached to a part (20) of the Jacquard machine and being provided for being connected to at least one tackle cord (2), wherein the device (1) is equipped with a springy element (15) exercising a pushing force on the device (1) in a direction opposite to the tractive force exercised on the device (1) by the tackle cord (2).

2. Device according to claim 1, wherein the device (1) is provided with at least one projection (12*a*, 12*b*) which may be brought into a corresponding opening (21*a*, 21*b*) in said part (20) of the Jacquard machine, and in that the projection (12*a*, 12*b*) has a variable form and dimensions, the extremity (13*a*, 13*b*) of the projection (12*a*, 12*b*) having a form or dimensions larger than the form or dimensions of said opening (21*a*, 21*b*), such that the projection (12*a*, 12*b*) having been brought, into the opening (21*a*, 21*b*) is placed in a blocking position with respect to the opening (21*a*, 21*b*).

3. Device according to claim 2, wherein the device (1) is provided with two projections, namely a first (12*a*) and a second projection (12*b*), which are designed to be brought into a first (21*a*) and a second opening (21*b*) respectively.

4. Device according to claim 2, wherein in that the two projections (12*a*, 12*b*) at least partly, are of a cylindrical form having two or more diameters, the extremity (13*a*, 13*b*) of the projections (12*a*, 12*b*) having the largest diameter and the part (14*a*, 14*b*) situated between this extremity (13*a*, 13*b*) and the attachment of the projections (12*a*, 12*b*) to the device (1) having the smallest diameter.

5. Device according to claim 4, wherein said second opening (21*b*) comprises two partial openings, a first partial opening (22*a*) having a diameter which is larger than the extremities (13*a*, 13*b*) of the second projection (12*b*) and a second partial opening (22*b*) having a diameter which is larger than or fitting for a second part (14*a*, 14*b*) which is situated between this extremity §13*a*, 13*b*) and the attachment of the projections (12*a*, 12*b*) to the device (1).

6. Device according to claim 5, wherein said partial openings (22, 22*b*) are open circles, there being an opening angle between the two circles which is smaller than 180° and in that the second projection (12*b*) is provided with a third part (17*b*), which is situated between said extremity (13*b*) of the projection (12*b*) and said second part (14*b*), the diameter being larger than the diameter of said second part (14*b* and smaller is than the diameter of the extremity (13*b*) of the second projection (12*b*) and it being not possible to shift said third part (17*b*) through the said opening angle, but having indeed a diameter which is fitting for or smaller than the diameter of the second partial opening (22*b*) of said second opening (21*b*).

7. Device according to claim 1, wherein said part of the Jacquard machine is a retaining plate (20) in which one or several devices (1) may be installed.

8. Device according to claim 1, wherein said device (1) is provided with at least one recess (16*a*, 16*b*), having the form of a corresponding tool (30) to install or to remove one or several devices (1).

9. Device according to claim 8, wherein the device (1) is provided with two recesses (16*a*, 16*b*), at least one recess (16*a*, 16*b*) being provided with a bulge (31) fitting into an opening (32) in the tool (30), said bulge (31) and said opening (32) being designed such that when shifting the tool (30) onto said device (1) the tool will slide over the bulge (31) in a springy manner, until the opening (32) in the tool (30) is enclosing the bulge (31) of the device (1).

10. Device according to claim 1, wherein the top (10) of the device (1) comprises at least one plane inclining downwards towards the side.

11. Device according to claim 1, wherein the device (1) comprises two guide eyes (9), which are situated at different levels.

12. Jacquard machine provided with a fixed, adjustable or movable grid and a number of retaining plates, which are attached to the grid and which are provided for attaching a number of devices according to claim 1.

* * * * *